US012352043B2

(12) United States Patent
Daudet

(10) Patent No.: US 12,352,043 B2
(45) Date of Patent: Jul. 8, 2025

(54) FIRE STOP INSTALLATION AT TOP PLATE OF TIE DOWN SYSTEM

(71) Applicant: Simpson Strong-Tie Company Inc., Pleasanton, CA (US)

(72) Inventor: Larry Randall Daudet, Brentwood, CA (US)

(73) Assignee: Simpson Strong-Tie Company Inc., Pleasanton, CA (US)

( * ) Notice: Subject to any disclaimer, the term of this patent is extended or adjusted under 35 U.S.C. 154(b) by 0 days.

(21) Appl. No.: 17/151,196

(22) Filed: Jan. 17, 2021

(65) Prior Publication Data

US 2021/0222426 A1 Jul. 22, 2021

Related U.S. Application Data

(60) Provisional application No. 62/962,930, filed on Jan. 17, 2020.

(51) Int. Cl.

| | |
|---|---|
| ***E04B 1/94*** | (2006.01) |
| ***E04H 9/02*** | (2006.01) |
| ***E04H 9/14*** | (2006.01) |

(52) U.S. Cl.

CPC ..... *E04B 1/947* (2013.01); *E04B 1/948* (2013.01); *E04H 9/021* (2013.01); *E04H 9/14* (2013.01)

(58) Field of Classification Search

CPC . E04B 1/947; E04B 1/948; E04H 9/14; E04H 9/021

See application file for complete search history.

(56) References Cited

U.S. PATENT DOCUMENTS

| | | | | |
|---|---|---|---|---|
| 4,572,695 | A | 2/1986 | Gilb | |
| 5,103,609 | A | 4/1992 | Thoreson et al. | |
| 5,105,592 | A | 4/1992 | MacMilan | |
| 5,146,720 | A | 9/1992 | Turner | |
| 5,347,767 | A * | 9/1994 | Roth | F16L 5/04 52/220.8 |
| 5,471,805 | A | 12/1995 | Becker | |
| 5,519,977 | A | 5/1996 | Callahan | |
| 5,546,711 | A | 8/1996 | Heller | |
| 5,586,739 | A | 12/1996 | Gantner et al. | |
| 5,709,049 | A * | 1/1998 | Baird | B29B 17/0042 47/21.1 |
| 5,876,042 | A | 3/1999 | Graf et al. | |
| 5,913,788 | A | 6/1999 | Herren | |
| 5,992,125 | A | 11/1999 | Hardy | |
| 6,058,668 | A | 5/2000 | Herren | |
| 6,074,714 | A | 6/2000 | Gottfried | |

(Continued)

OTHER PUBLICATIONS

International Search Report and Written Opinion of the International Searching Authority, PCT Application No. PCT/US21/13787, Apr. 6, 2021, 9 pages, International Search Authority—US, Washington, D.C., United States.

(Continued)

*Primary Examiner* — Brian E Glessner
*Assistant Examiner* — Adam G Barlow
(74) *Attorney, Agent, or Firm* — Charles R. Cypher

(57) ABSTRACT

A take-up system and continuity tie system that uses fire stopping intumescent materials to help prevent and inhibit the travel of fire along the continuity tie system, due to the openings in the members of the building that receive the continuity tie system.

20 Claims, 10 Drawing Sheets

(56) References Cited

U.S. PATENT DOCUMENTS 6,176,057 B1 1/2001 Bouchet et al.
6,195,949 B1 * 3/2001 Schuyler ..... E04C 5/12 52/223.13
7,082,730 B2 8/2006 Monden et al.
7,681,365 B2 * 3/2010 Klein ..... E04B 2/7457 52/302.1
7,735,295 B2 6/2010 Surowiecki
7,752,817 B2 * 7/2010 Pilz ..... E04C 3/09 52/844
8,087,205 B2 * 1/2012 Pilz ..... E04B 1/948 52/232
8,336,832 B2 12/2012 Walraven et al.
8,590,231 B2 * 11/2013 Pilz ..... E04B 2/7457 52/232
8,595,999 B1 * 12/2013 Pilz ..... E04B 2/7411 52/232
8,672,275 B2 3/2014 Van Walraven et al.
8,751,206 B1 * 6/2014 Espinosa ..... G06F 30/13 52/293.3
8,881,478 B2 * 11/2014 Gray ..... E04B 1/26 52/223.14
8,973,319 B2 3/2015 Pilz et al.
9,121,527 B2 9/2015 Munzenberger et al.
9,145,987 B2 * 9/2015 Muenzenberger ... H02G 3/0412
9,151,042 B2 10/2015 Simon et al.
9,523,193 B2 * 12/2016 Pilz ..... E04B 1/945
9,809,974 B1 11/2017 Brekke
9,861,843 B2 1/2018 Paetow et al.
10,184,593 B2 1/2019 Pijpstra et al.
10,220,226 B2 3/2019 Foerg
10,406,389 B2 9/2019 Pilz et al.
10,993,384 B2 * 5/2021 Carter ..... A01D 34/001
11,131,088 B2 9/2021 Benton et al.
2005/0055897 A1 * 3/2005 Commins ..... E04H 9/14 52/169.1
2008/0060297 A1 * 3/2008 Espinosa ..... E02D 27/34 411/533
2009/0107082 A1 * 4/2009 Commins ..... E04H 9/14 52/745.12
2009/0178363 A1 * 7/2009 Pilz ..... E04C 3/09 52/846
2013/0340366 A1 12/2013 Gray
2014/0077043 A1 * 3/2014 Foerg ..... H02G 3/0412 248/74.1
2015/0275510 A1 * 10/2015 Klein ..... E04B 2/7411 52/232
2016/0130802 A1 * 5/2016 Pilz ..... E04B 1/948 52/483.1
2017/0089063 A1 * 3/2017 Espinosa ..... E04H 9/14
2017/0175386 A1 * 6/2017 Pilz ..... E04B 1/944
2017/0234004 A1 * 8/2017 Pilz ..... E04B 2/7457 52/232
2018/0016784 A1 1/2018 Hensley et al.
2019/0316350 A1 * 10/2019 Pilz ..... E04B 2/7411

OTHER PUBLICATIONS

International Preliminary Report on Patentability, PCT Application No. PCT/US 21/13787, Jul. 19, 2022, 6 pages, International Search Authority—US, Washington, D.C., United States.

Communication pursuant to Rules70(2) and 70a(2) EPC, European Patent Application 21741935.7, Feb. 6, 2024, 10 pages, European Patent Office, Munich, Germany.

* cited by examiner

FIRE STOP INSTALLATION AT TOP PLATE OF TIE DOWN SYSTEM

BACKGROUND OF THE INVENTION

The present invention relates generally to building construction and reinforcement, and specifically to a continuity system that resists tension from wind uplift forces or overturning forces from wind or seismic events while compensating for the downward settling of buildings caused by shrinkage of wooden members. More specifically, the present invention relates to a fire stopping system placed at the plate of a continuity system.

A continuity system is a secondary support system that ties walls or other building elements together and resists lateral overturning forces or uplift forces from events such as earthquakes or strong winds. Earthquake and wind forces produce overturning and uplift loads in the building, which load the building elements in overturning or uplift with respect to the building foundation. A continuity system resists such movements of the building elements. A continuity system generally comprises a plurality of interconnected vertically-oriented elements, typically metal rods and bearing plates, or holdowns, that provide a discrete structural mechanism or load path framework for the transfer of loads through the building from the structural elements that are intended to resist such forces, such as roof or floor diaphragms and shearwalls, to the continuity system, and then to the foundation. For example, the presence of a continuity system enables wall panels to resist overturning and/or moments that might damage or destroy the wall.

A known continuity system is described in U.S. Pat. No. 4,875,314 ("the '314 patent"), the entire disclosure of which is hereby incorporated herein by reference. The '314 patent describes a system in which at least one tie rod is connected to the foundation through a simple threaded coupler and a foundation anchor. Although the tie rod system can be used in a single-story structure, it is particularly suited to multistory structures, as illustrated in the '314 patent. In a multistory structure, a series of anchor elements is used to couple multiple tie rods in a line from the foundation to the top plate of the top story of the structure. The anchor elements of the '314 patent, in addition to coupling tie rods together, are used to secure the tie rods at each level of the structure to eliminate initial slack in the system. The principal shortcoming of the system of the '314 patent is the lack of a means of compensating for slack that builds up in the system as the wood structural members shrink over time. As slack builds up in the system, the system's capacity to resist uplift is correspondingly reduced.

The prior art includes a number of technical solutions to the problem of increasing slack in continuity systems. Simpson Strong-Tie Company's Anchor Tiedown System uses the TUD and ATUD take-up devices, as well as the CTUD coupling take-up device. The CTUD coupling take-up device is the subject of U.S. Pat. No. 7,905,066, granted to Steven E. Pryor et al. All three devices are driven by a torsion spring. The TUD and ATUD are slipped over the tie rod between a horizontally disposed member and a nut threaded onto the tie rod, and they expand to fill the space as it space enlarges. The CTUD threads onto and couples the vertically-aligned ends of two tie rods, drawing the two together to maintain tight connections between the wood and steel elements as the wood structural members shrink over time. Similar continuity systems with ratcheting take-up devices are described in U.S. Pat. No. 6,007,284 the entire disclosure of which is hereby incorporated herein by reference, and U.S. Pat. No. 7,744,322, the entire disclosure of which is also hereby incorporated herein by reference, and U.S. Pat. No. 8,881,478, the entire disclosure of which is also hereby incorporated herein by reference. With the system shown in U.S. Pat. No. 8,881,478, when a tie rod is first inserted up into the housing, the upward movement of the tie rod forces the insert segments apart from a constricted position—the constriction preferably caused by the downward force of gravity and possibly by a compression member placed above the insert segments, combined with the narrowing in the lower portion of the outer bore of the housing—to the width of the tie rod. The interface between the surfaces of the tie rod and the insert segments creates a ratcheting action as the tie rod is pushed up and the insert segments move up and out laterally, allowing the tie rod to be inserted as far as needed into the housing for installation. When the building shrinks, the relative movement of the tie rod and the housing is similar to movement during installation. The relative upward movement of the rod with respect to the housing pushes the insert segments up and out laterally, and gravity, and any compression member, if used, and any relative downward movement of the tension rod as well as the usual tension that is placed on the rod once it is installed pulls the insert segments downwardly and inwardly in combination with the narrowing of the outer bore of the housing and thus against the rod, holding it with respect to the housing.

Ratcheting take-up devices are useful for keeping continuity systems under tension so they can work effectively; however, this means that the rods can move through the openings in the plates in the wall of the building over time. It is desirable for these rods to move through the openings in the plates or horizontal members of the walls unhindered, so generally the holes in the plates are over-sized. This creates room for the rods, cables or vertical members of the continuity system to move; however, it also creates openings for heat and fire to pass from one portion of a building to another during a fire event. Ideally, these openings could be blocked with fire caulking or another intumescent material; however, the inventor has found that such fire caulking hardens over time and interferes with the take-up movement of the rods or other vertical members of the continuity system.

The fire stopping system of the present invention is designed to work with continuity systems, and specifically with continuity systems that use ratcheting take-up devices and such systems that compensate for tie rods that are not perfectly perpendicular to the top and bottom plates.

SUMMARY OF THE INVENTION

The fire stopping system of the present invention has a layer of intumescent material that expands when exposed to high temperatures such as those that generated by a fire event in the building near the intumescent pad. The pad of intumescent material is attached to the horizontal member of the building where the continuity system passes through the horizontal member. An opening is formed in the intumescent pad where the vertical member of the continuity system passes through the pad. The opening can be a closed opening in the pad or it can extend and communicate with the outer edge of the intumescent pad. The intumescent pad can be covered with a plate or washer. The plate or washer helps to direct the expansion of the intumescent material laterally and around the vertical member of the continuity system. If the intumescent pad is used with a covering plate, the intumescent pad or pads can be attached to the cover plate prior to installation, or they can be attached separately. When an undesired fire event occurs in the building that raises the temperature sufficiently near the pad, the intumescent material of the pad will expand around the continuity member and the opening in the horizontal member of the building, closing off the opening in the horizontal member to the passage of gasses and insulating the horizontal member from heat generated by the fire event so as to inhibit the spread of the fire through and across the horizontal member.

An important advantage of the fire stop system of the present invention is that it can be installed after the continuity system is in place. If the opening in the pad has a slit that communicates with the outer edge of the pad, then the pad can be opened up to fit over and around a vertical member of a continuity system that is already in place. If a plate is used with the pad, the plate will have an opening for receiving the vertical member of the continuity system and the plate can be formed with a slit that communicates with the opening and the edge of the plate that will allow the plate to open and fit over and around the continuity member. Additional weakening openings can be formed in the plate to help it to bend to fit over the continuity member. The intumescent pad can be provided with adhesive material on the face that will engage the surface of the plate member in the wall. The intumescent pad can also be provided with adhesive material on the of the face that will engage the covering attachment plate. Openings can be formed in the intumescent pad and the covering plate to receive fasteners to attach the fire stop system to the horizontal plate.

A further advantage of the present invention is that the fire stop system is shaped and arranged to allow a tie rod to be quickly inserted through the bore in the horizontal member.

A further object of the present invention is to provide a pliable and bendable intumescent pad that is approximately ⅛" thick. The opening in the intumescent material can be of different shapes and sizes. If a smaller opening is used so that the pliable intumescent material sits closer to the continuity member, radial slits that extend from the opening, or other differently shaped cut-outs can be provided in the pad to allow the pad to more easily flex if the continuity member comes into contact with the pad.

DETAILED DESCRIPTION

For clarity and convenience, the take-up device 1 and the continuity system and fire stopping system of the current invention is described in a single, most common, orientation (except as noted otherwise) in which a top faces up and a bottom faces down. The take-up device 1 and fire stopping system can, nevertheless, be installed in essentially any orientation, so that a top can face down or to the side and a bottom can face up or to the side.

Figure 2:
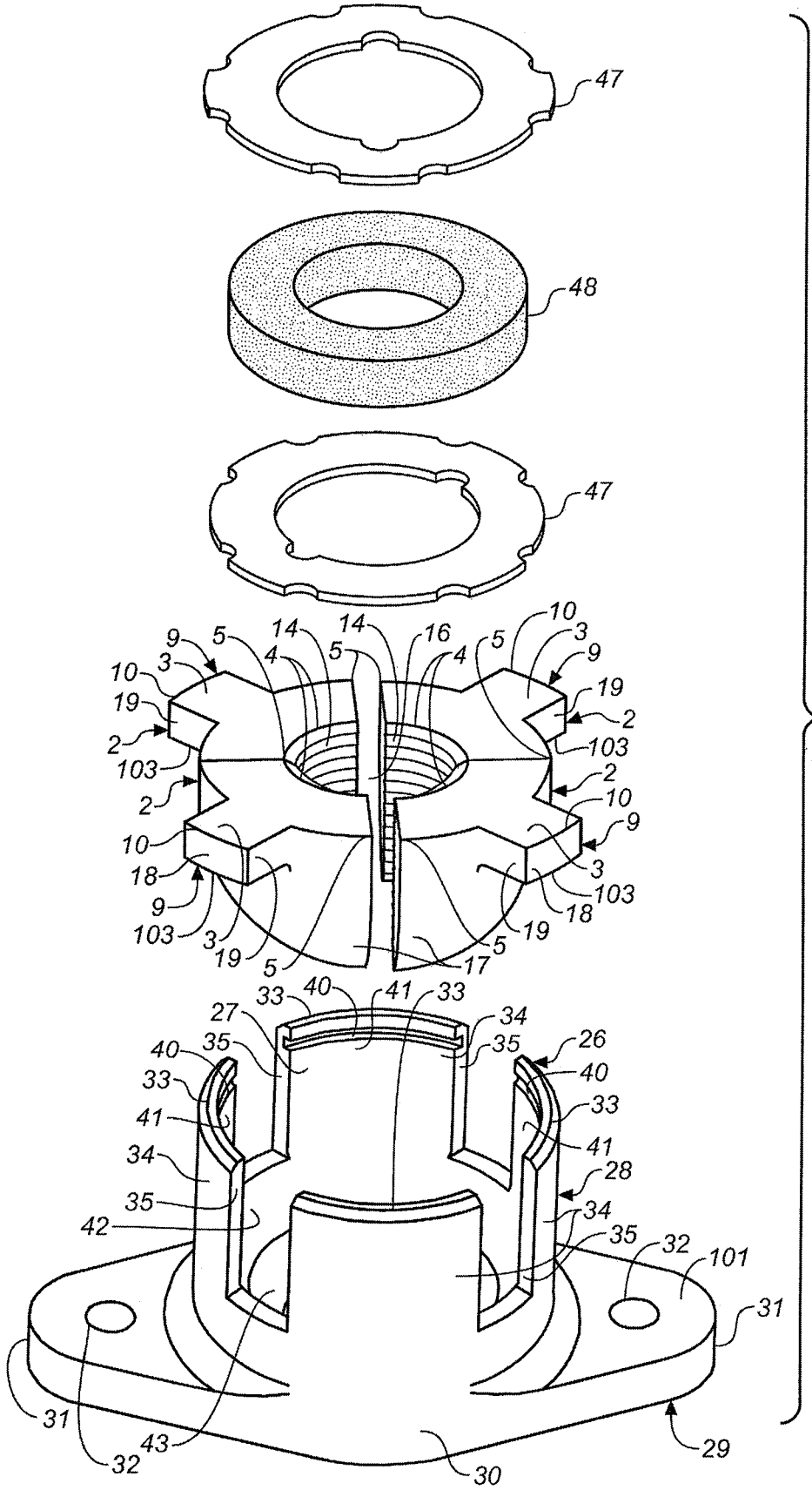
FIG. 2 is an exploded perspective view of the take-up device of the present invention.

As best shown in FIG. 2, the take-up device 1 of the present invention preferably has four insert segments 2 arranged sectionally around an inner bore 16. Greater or lesser numbers of insert segments 2 are possible, but four is preferred. The insert segments 2 are designed to grasp a preferably vertical tie rod or threaded bolt 24. Preferably, vertical tie rod 24 is a least threaded where it is grasped by insert segments 2. Vertical tie rod 24 can be wholly threaded, partially threaded, or unthreaded, although if is unthreaded it is preferable to have a grooved surface that can mate with similar grooves on the insert segments 2 for achieving design load values, although alternate methods of the grasping of the insert segments 2 of the tie rod 24 are encompassed within the invention. The insert segments 2 preferably surround the tie rod or threaded bolt 24, but with gaps between the insert segments 2. Preferably, each insert segment 2 has a substantially planar top surface 3.

The top surface 3 need not be planar, but it is generally advantageous to maximize the area of the top surface 3 because the top surface 3 is where the insert segments 2 are pushed down by compression member 46 which helps to prevent the insert segments 2 from rotating too far out of their upright orientation when the tie rod 24 pushes them upwardly and outwardly during shrinkage of the building or installation of the tie rod 24, and thus the insert segments 2 are properly positioned to grasp the tie rod 24 as firmly as possible when the tie rod 24 is in tension again. The top surface 3 of each insert segment 2 preferably has a concave inner bore-defining edge 4 that has a first end 5 and a second end 5. The inner bore-defining edge 4 is preferably an arc 4. Preferably, a substantially straight first side edge 6 connects the first end 5 of the concave inner bore-defining edge 4 to the first end 8 of a convex outer bore edge 7. Preferably, a substantially straight second side edge 6 connects the second end 5 of the concave inner bore-defining edge 4 to a second end 8 of the convex outer bore edge 7. The first and second substantially straight side edges 6 of the top surface 3 are preferably orthogonal to each other. The outer bore edge 7 is preferably a nearly 90-degree arc 7 except where the arc 7 is interrupted by a tab 9 that projects from the convex outer bore edge 7. Preferably, the tab 9 has a slightly curved outer edge 10 with first and second ends 11 that are connected to the arc 7 by first and second substantially straight side edges 12, respectively. The tab 9 is preferably formed as an integral part of the insert segment 2, rather than as a separate part attached to the insert segment 2.

As best shown in FIG. 2, each insert segment 2 preferably has first and second substantially planar sides 13 perpendicular to the top surface 3. Preferably, the first substantially planar sides 13 extend downward from the first and second edges 6 of the top surface 3. The first and second substantially planar sides 13 are preferably orthogonal to each other.

Each insert segment 2 preferably has a rough, threaded, concave inner bore-defining surface 14 that extends downward from the concave inner bore-defining edge 4 and connects the first and second substantially planar sides 13. Preferably, each bore-defining surface 14 is primarily a section of a rough, threaded, right circular cylindrical surface 15 that defines the inner bore 16. Each insert segment 2 preferably has an outer bore-interfacing surface 17 that extends downward from the arc 7 of the outer bore edge 7.

As best shown in FIG. 2, a portion 103 of the substantially planar top surface 3 of each insert segment 2 preferably extends radially outward away from the inner bore 16 to form the top surface 103 of each tab 9, bounded by the outer edge 10 and the two sides edges 12 of each tab 9. Preferably, each tab has a substantially planar outer surface 18 that descends from the outer edge 10. Each tab 9 preferably has first and second substantially planar side surfaces 19 that descend from the first and second side edges 12, respectively, of the tab 9. Preferably, each tab 9 has a substantially planar bottom surface 20 opposite the top surface 103 of the tab 9.

Preferably the general shape of the lower portion of the outer bore-interfacing surfaces 17 of the insert segments 2 is collectively that of a spherical segment—a spherical cap with the top truncated or a spherical frustum. In the currently preferred embodiments of the present invention a radius of 0.5 inches is preferred. The insert segments 2 generally have the form of an inverted dome with the inverted apex cut off parallel to the base. If there are four insert segments 2, each is approximately one quarter of the spherical frustum and the spherical frustum is vertically quartered, and the quarters preferably spaced slightly apart. Two segments 2 side-by-side have the general shape of an inverted semi-dome. The outer bore-interfacing surfaces 17 preferably taper from the top surfaces 3 of the insert segments 2 to bottom edges 21 of the insert segments 2, reducing the cross-section of each insert segment 2 from the top surface 3 to the bottom edge 21. Preferably, the general shape of the upper portion 104 of the outer bore-interfacing surface 17 of the insert segments 2 is collectively that of a cylinder with tabs 9 splayed circumferentially. The lower portion 105 the outer bore-interfacing surface 17 of the insert segments 2 curves inward. The insert segments 2 together preferably form an inverted dome with a central vertical through-bore.

Preferably threaded, inner bore-defining surface 14 of each insert segment 2 extends from a top end 22 to a bottom end 23, where the inner bore 16 flares outward with a substantially annular widening taper surface 36, or chamfer 36, on each insert segment 2 that meets the bottom edge 21 of each insert segment. These flared, or beveled, bottom portions 36 of the inner bore 16 are where the tie rod or threaded bolt 24 is inserted; the flared portions 36 ease insertion of the tie rod or threaded bolt 24. Each substantially planar widening taper surface 36 is preferably oriented at 45 degrees to the top surfaces 3 of the insert segments 4 and at 45 degrees to the central axis 100 of the take-up device 1, with the acceptable range being up to 15 degrees more or less. Preferably, each taper surface 36 is a surface section of a conical frustum. In the currently preferred embodiments of the present invention, the flared bottom portions 36 widen the inner bore 16 to a maximum width of 0.545 inches across. In the currently preferred embodiments of the present invention, the bottom edge 21 is preferably not a true edge, but is instead a very narrow annular surface 21, a flat base 21 that helps to stabilize the insert segments 2. The height of the insert segments 2 is sufficient to grasp enough of the tie rod or threaded bolt 24 for a secure connection 110 by connecting to multiple turns of the threaded bolt 24. In the currently preferred embodiments of the present invention, the insert segments 2 are held apart by the tie rod or threaded bolt 24.

The insert segments 2 fit into an outer bore 27 in a housing 26 that holds the segments 2 in the correct sectional arrangement to form the inner bore 16. The housing 26 is preferably a seamless, unitary member 26 with a vertical body 28 that is preferably cylindrical and contains the outer bore 27 and a horizontal plate 29 below the vertical body 28. The horizontal plate 29 has a top face 101 and a bottom face 102. Preferably, the horizontal plate 29 is shaped generally as an elongated rhombus with two relatively closely spaced corners 30 and two relatively distantly spaced corners 31. The two relatively closely spaced corners 30 and two relatively distantly spaced corners 31 are preferably rounded. The two closely spaced opposing corners 30 do not extend beyond the cylindrical body 28 and match the curvature of the cylindrical body 28 where the plate 29 and cylindrical body 28 coincide. The two distantly spaced opposing corners 31 are spaced away from the cylindrical body 28. The plate 29 has a fastener opening 32 between each distantly spaced 31 corner and the cylindrical body 28.

The top edge 33 is preferably flat except where it is notched with a number of indentations or slots 35 that match the tabs 9 on the insert segments 2. Each tab 9 preferably fits in an indentation 35 and preferably extends outside the vertical body 28, and the interlock prevents the insert segments 2 from rotating around the central axis 100. The interface between the tabs 9 and the indentations 35 also helps to stabilize the insert segments 2, helping to keep them level especially when a threaded rod 24 is inserted into the inner bore 16. Rather than being screwed into the inner bore 16, the threaded rod 24 is preferably pushed in without rotation and the insert segments 2 react by moving apart and together, ratcheting when the threaded inner bore 16 interfaces with a threaded bolt 24. The compression member 46 allows the insert segments 2 to move up within the housing 26, and the upwardly-widening outer bore 27 allows the insert segments 2 to move apart. This allows the threaded bolt 24 to be inserted into the inner bore 16, and as the threaded bolt 24 and the threaded portion of inner surfaces 14 of the insert segments 2 slide against each other, the segments 2 are moved up and outwardly and down and inwardly repeatedly, the inward motion urged by the compression member 46 and the narrowing outer bore 27 in the housing 2. The threaded bolt 24 can only be inserted in one direction because when it is pulled down, the downwardly-narrowing outer bore 27 forces the insert segments 2 against the threaded rod 24 so that the threaded bolt 24 and the threaded portion of inner surfaces 14 of the insert segments 2 interlock as if the threaded bolt 24 had been screwed into a conventional solid nut.

Preferably the housing 26 has a lateral horizontal axis 37 that passes through centers of the two fastener openings 32 and the center of the outer bore 27, which is preferably also the center of the cylindrical body 28, the housing 26 and the inner bore 16.

Preferably, the housing 26 also has a medial horizontal axis 38 that also passes through the center of the outer bore 27 and is orthogonal to the lateral horizontal axis 37. The indentations 35 are preferably centered on first and second diagonal horizontal axes 39 that are 45 degrees off of the lateral horizontal axis 37 and the medial horizontal axis 38.

Figure 1:
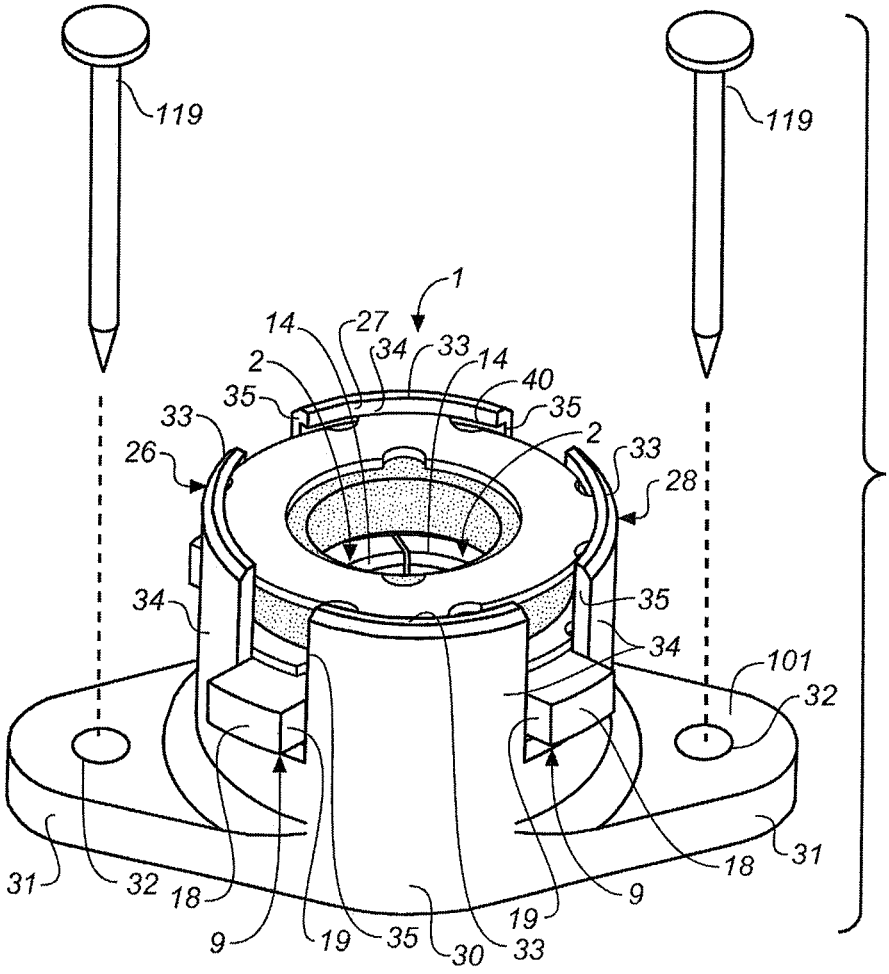
FIG. 1 is a perspective view of the take-up device of the present invention.

As best shown in FIG. 1, preferably the insert segments 2 are retained within the outer bore 27 by a compression member 46. The compression member 46 preferably comprises a lower hard washer 47, a middle soft washer 48 and an upper hard washer 47. The middle soft washer 48 is preferably made from a resilient material like rubber that, when compressed, stores energy and expands when compression forces are released. Preferably, the middle soft washer 48 is made from soft quick-recovery super-resilient polyurethane foam.

The middle soft washer 48 functions like a standard metal compression spring and a spring could be used, but the washer 48 is preferred. The inner diameters of the compression member 46 limit how far the insert segments 2 can tilt or rotate. The upper and lower hard washers 47 are preferably made from steel. Preferably, each has an inner edge 50, an outer edge 51, an upper surface 52 and a lower surface 53. Preferably, the inner edge 50 and the outer edge 51 are both generally circular. Preferably, the outer edge 51 has four pairs of inclusions 54. Each pair of inclusions 54 preferably is 90 degrees apart around the circumference of the outer edge 51. Preferably, between the inclusions 54 of each pair is a small arc 55. Preferably, between each pair of inclusions 54 is a large arc 56. The preferred total of eight inclusions 54 in the outer edge 51 bound an inner area with a circumference 57. Preferably, the small arcs 55, which project slightly from the rest of the outer edges 51 of the upper and lower hard washers 47, and are therefore on slight projections 49 that are inserted in the indentations 35 in the wall 34 of the cylindrical body 28 of the housing 26 of the take-up device 1. The lower hard washer 47 is stabilized by the interfaces between the small arcs 55 and the indentations 35. The upper hard washer 47 is rotated so small arcs 55 slide into the groove 40 in the wall 34 of the cylindrical body 28 of the housing 26 of the take-up device 1. This locks the upper hard washer 47 in place. The upper hard washer 47 holds the middle soft washer 48 and the lower hard washer 47 in place, and this whole compression member 46 holds the insert segments 2 down within the outer bore 27 of the take-up device 1. When the insert segments 2 push up, the middle soft washer 48 compresses and, because it is resilient, the middle soft washer 48 pushes the insert segments 2 down when the upper hard washer 47 is locked in place. The whole compression member 46 functions as a spring tailored for the best performance in this device 1 and connection 110. The interface between the outer bore-interfacing surfaces 17 of the insert segments 2 and the inward-angled and inward-curved portions 42 and 43 of the outer bore 27 forces the insert segments 2 together. The insert segments 2 clamp together on the tie rod or threaded bolt 24. The matching curvatures of the bore-interfacing surfaces 17 of the insert segments 2 and the inward-curved portions 43 of the outer bore 27 allow the insert segments 2 to rotate or swing on a horizontal axis generally orthogonal to, and intersecting with, the tie rod or threaded bolt 24 without diminishing the interface area. This allows the take-up device 1 to compensate for imperfect alignment of the tie rod or threaded bolt 24 without diminishing the strength of the connection 110. The insert segments 2 can tilt, or rotate, in any direction. Generally, the segments 2 need only rotate a maximum of two degrees from the central axis 100, but the ability to do this without diminishing the interface with the outer bore 27 and the strength of the connection 110 is substantially advantageous since tie rods or threaded bolts 24 are rarely, if ever, aligned perfectly.

Figure 3:
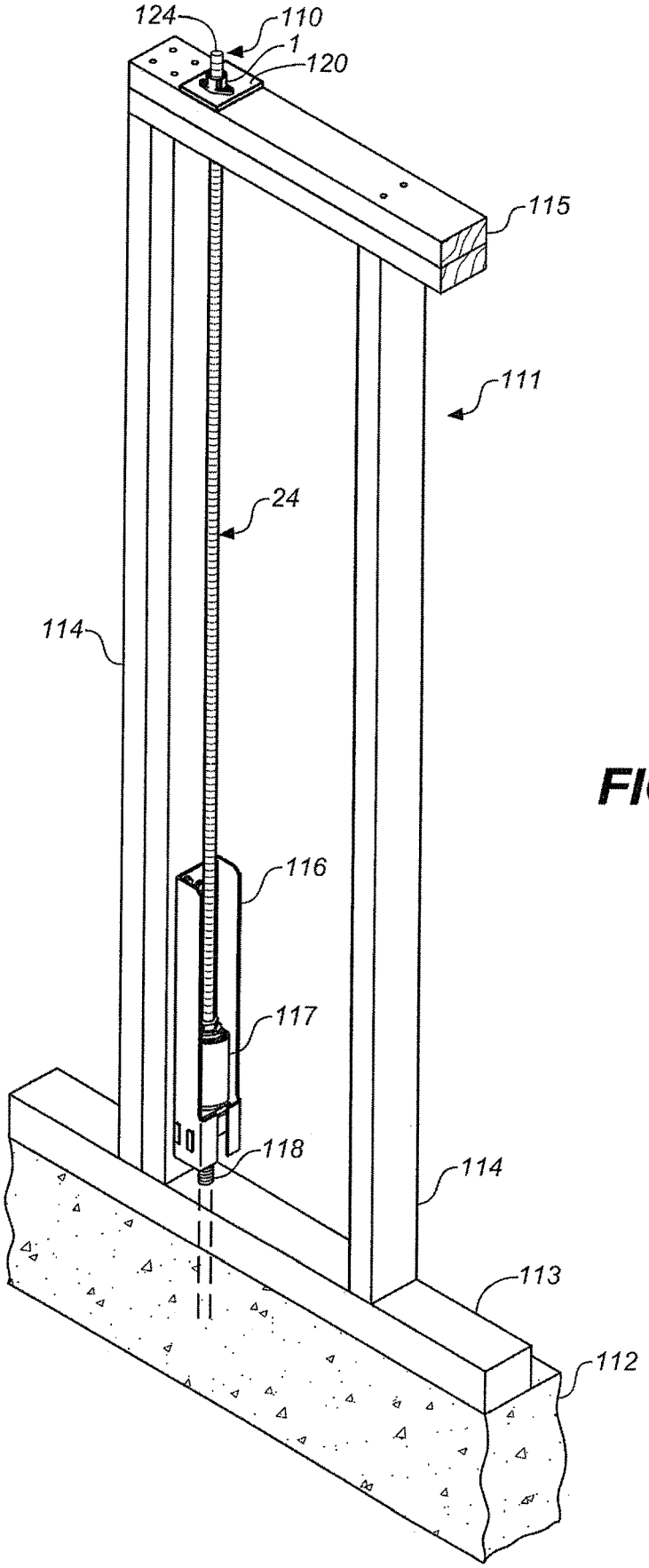
FIG. 3 a perspective view of a connection made with the take-up device of the present invention, showing the take-up device installed on the top plate of a stud wall.

As shown in FIG. 3, an anchor bolt 118 is embedded in a concrete foundation 112. The anchor bolt 118 passes through the horizontal bottom plate 113 of a wall 111, in this case the mudsill 113, and it attached to a coupler 117 that bears down on a holdown 116 that is mounted on one of the vertical wall studs 114. The coupler 117 joins the anchor bolt 118 to an in-line threaded rod 24 that runs parallel to the wall stud 114 and up through the double top plate 115, where it is secured to the top plate 115 by a take-up device 1 of the present invention that is fastened to the top plate 115 with a bearing plate 120 sandwiched between the bottom face 102 of the take-up device 1 and the top plate 115.

Figure 4:
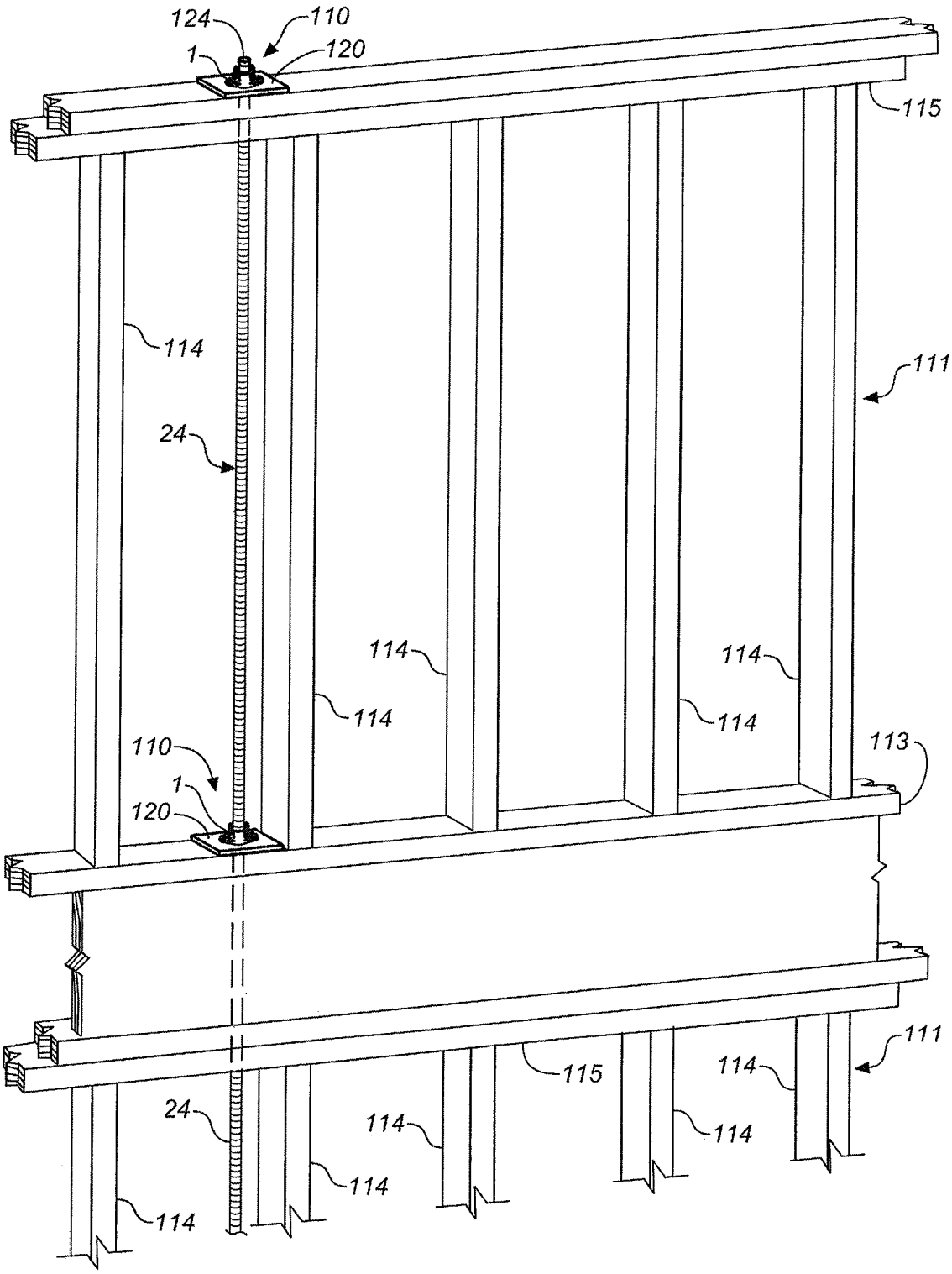
FIG. 4 is a perspective view of a connection made with the take-up device of the present invention, showing two take-up devices of the present invention, each installed on a different level of the same structure.

As shown in FIG. 4, take-up devices 1 of the present invention can be placed at every level of a multistory structure. In FIG. 4, a first take-up device 1 is shown fastened to the bottom plate 113 of an upper floor and a second take-up device 2 is attached to the top plate 115 directly above.

The take-up device 1 that has a housing 26 and a plurality of insert segments 2. The housing 26 has an outer bore 27 and the outer bore 27 has a lower inward-curved portion 43 that is frusto-spherical. The insert segments 2 each has an outer bore-interfacing surface 17 that interfaces with the inward-curved portion 43 of the outer bore 27 of the housing 26. The outer bore-interfacing surfaces 17 of the plurality of insert segments 2 are at least in part collectively frusto-spherical. Each insert segment 2 has a concave inner bore-defining surface 14 and the plurality of concave inner bore-defining surfaces 14 define an inner bore 16. Preferably, the outer bore 27 of the housing 26 has a ledge 45, the insert segments 2 each have a bottom edge 21, and the bottoms edges 21 of the insert segments 2 interface with the ledge 45 in the outer bore 27, stabilizing the insert segments 2. The take-up device 1 preferably has four insert segments 2. Each insert segment 2 preferably has a substantially planar top surface 3. The top surface 3 preferably has a concave inner bore-defining edge 4 with first and second ends 5, a convex outer bore edge 7 with first and second ends 8, a first substantially straight side edge 6 that connects the first end 5 of the inner bore-defining edge 4 to the first end 8 of the outer bore edge 7, and a second substantially straight side edge 6 that connects the second end 5 of the inner bore-defining edge 4 to the second end 8 of the outer bore edge 7. Each segment 2 preferably also has a tab 9 on the convex outer bore edge 7, an inner bore-defining surface 14 that descends from the inner bore-defining edge 4, and an outer bore-interfacing surface 17 that descends from the outer bore-defining edge 7 and tapers a bottom edge 21. Preferably, the inner bore 12 of the take-up device 1 is threaded.

The housing 26 preferably also has a horizontal plate 29 and a vertical body 28 that surmounts the horizontal plate 29 and the outer bore 27 of the housing 26 is contained within the vertical body 28. Preferably, the vertical body 28 is cylindrical and has an outer wall 34 with a top edge 33, a plurality of indentations 35 extend down from the top edge 33 of the wall 34, and a tab 9 of an insert segment 2 interfaces with each of the indentations 35 in the wall 34 of the cylindrical vertical body 28. The insert segments 2 are preferably retained within the outer bore 27 by a compression member 46. Preferably, the compression member 46 has an upper hard washer 47, and a resilient lower soft washer 48 that pushes the insert segments 2 downward in the outer bore 27 and is restrained from upward movement by the upper hard washer 47. The compression member 46 preferably also has a lower hard washer 47 that is between the resilient lower soft washer 48 and the insert segments 2. Preferably, the upper and lower hard washers 47 each have an outer edge 51 with a plurality of projections 49. The outer bore 27 preferably has a groove 40 connected to the indentations 35 in wall 34 of the cylindrical body 28. Preferably, the projections 49 of the upper hard washer 47 project into the groove 40 in the outer bore 27, restraining the compression member 46. The projections 49 of the lower hard washer 47 preferably project into the indentations 35 in wall 34 of the cylindrical body 28, stabilizing the compression member 46.

Preferably, the take-up device 1 is part of a connection 110 that has a first structural member 115 to which the take-up device 1 is fastened, and a tie rod 24 with a top end 124 at least partially held within the inner bore 16 of the take-up device 1 by a plurality of the insert segments 2. The first structural member 115 preferably is a top plate 115 in an at least partially wood frame wall 111, and a bearing plate 120 is disposed between the first structural member 115 and the take-up device 1. Preferably, the tie rod 24 is secured to a foundation 112 below the wood frame wall 111.

The outer bore 27 of the take-up device 1 preferably has a central vertical axis 100. Preferably, when the tie rod 24 is not parallel to the central vertical axis 100 of the outer bore 27, the insert segments 2 that hold the tie rod 24 are canted so the inner bore 16 is parallel to the tie rod 24 where the tie rod 24 is held by the insert segments 2 but the inner bore is not parallel to the central vertical axis 100 of the outer bore 27.

Preferably, the connection 110 is formed by inserting the top end 124 of the tie rod 24 into the inner bore 16 of the take-up device and fastening the take-up device 1 to the first structural member 115. The take-up device 1 is preferably fastened to the first structural member 115 with a plurality of screws or nails 119. Screws provide a stronger connection than nails, but nails are less expensive and can still often provide the necessary strength for the connection.

Figure 5:
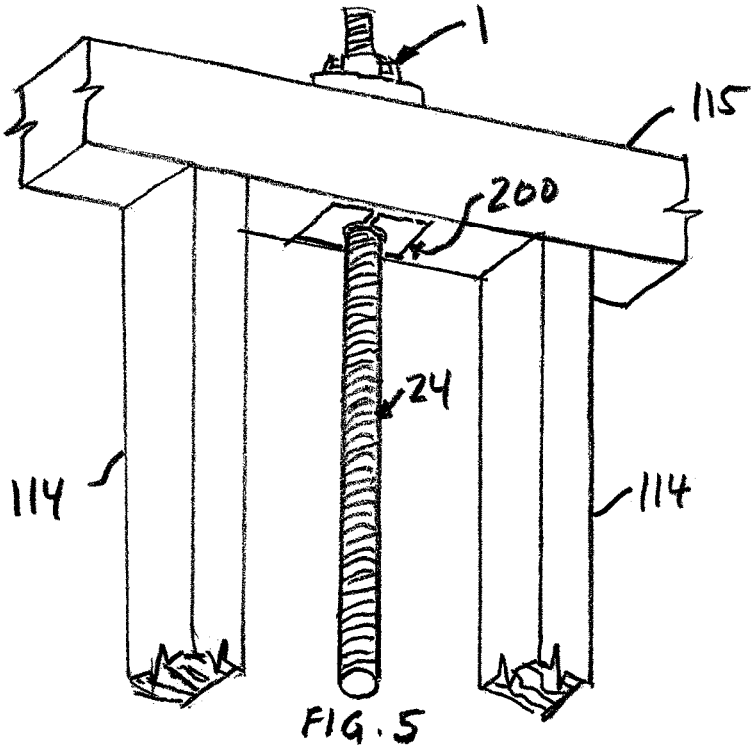
FIG. 5 is a perspective view of the present invention with an intumescent pad attached to the bottom of the horizontal member, a take-up device attached to the top of the horizontal member, and the tie rod of a continuity system passing through the horizontal member.

FIG. 5 is a perspective view of the present invention with an intumescent pad 200 attached to the bottom of the horizontal member 115, a take-up device 1 attached to the top of the horizontal member 115, and the tie rod 24 of a continuity system passing through the horizontal member 115. The pad 200 of intumescent material is attached to the horizontal member 115 of the building where the continuity system passes through the horizontal member 115. An opening 205 is formed in the intumescent pad 200 where the vertical member 24 of the continuity system passes through the pad 200.

Figure 6:
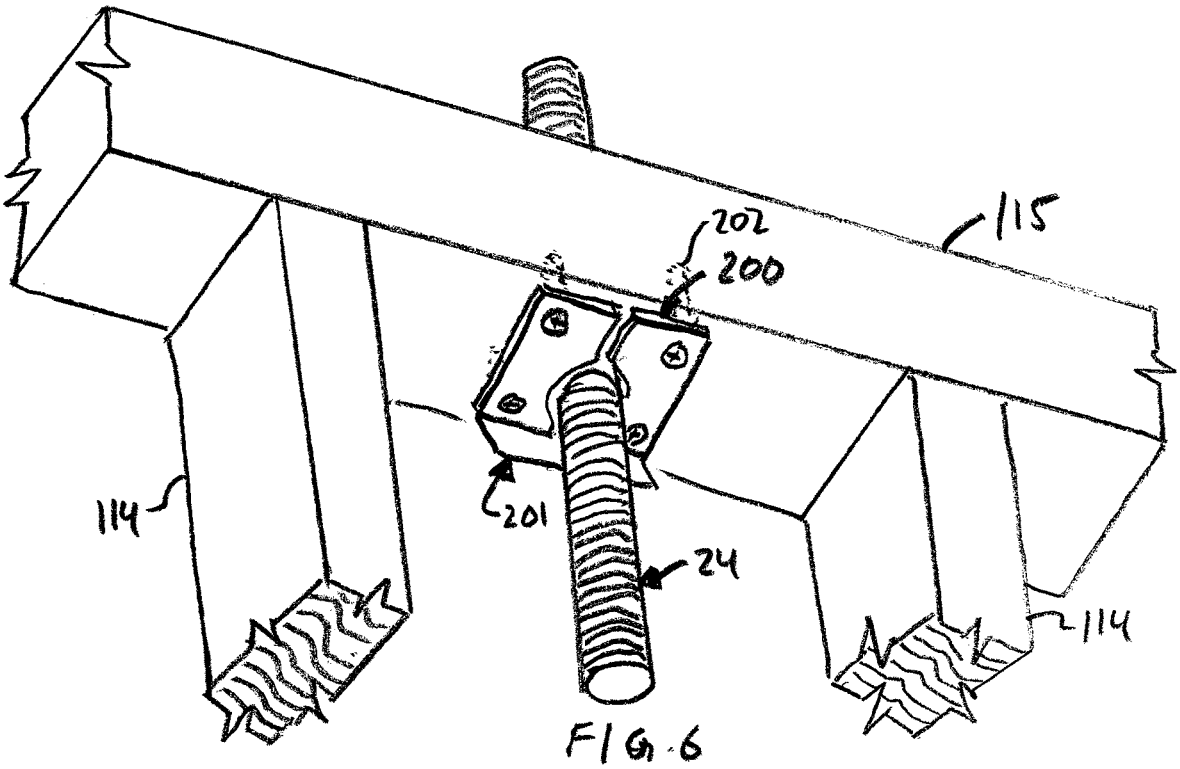
FIG. 6 is a perspective view of the present invention, similar to FIG. 5, except a plate has been attached to the intumescent pad. Fasteners are shown in dotted lines passing through the plate and the intumescent pad.

FIG. 6 is a perspective view of the present invention, similar to FIG. 5, except a covering plate 201 has been attached to the intumescent pad 200. Fasteners 202 are shown in dotted lines passing through the plate 201 and the intumescent pad 200. The intumescent pad 200 can be covered with a plate or washer 201. The plate or washer 201 helps to direct the expansion of the intumescent material laterally and around the vertical member 24 of the continuity system. If the intumescent pad 200 is used with a covering plate 201, the intumescent pad or pads 200 can be attached to the cover plate prior to installation, or they can be attached separately.

Figure 7:
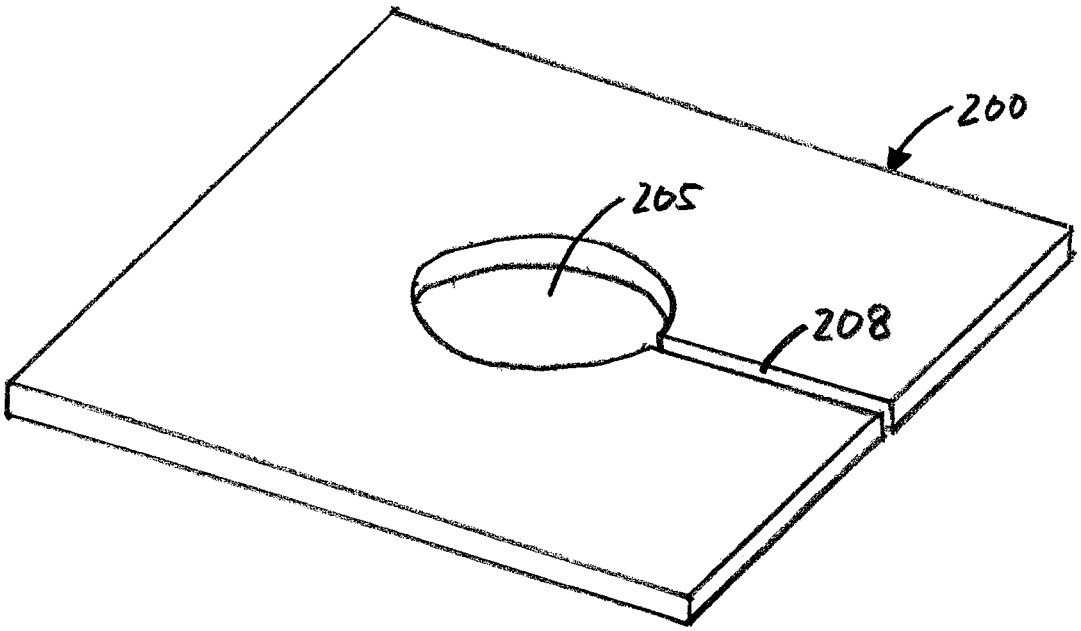
FIG. 7 is a perspective view of a intumescent pad of the present invention.

FIG. 7 is a perspective view of an intumescent pad 200 of the present invention. The opening 205 can be a closed opening in the pad 200 or the opening can extend and communicate with the outer edge 206 of the intumescent pad 200. An important advantage of the fire stop system of the present invention is that it can be installed after the continuity system is in place. If the opening 205 in the pad 200 has a slit 208 that communicates with the outer edge of the pad, then the pad can be opened up to fit over and around a vertical member 24 of a continuity system that is already in place.

Figure 8:
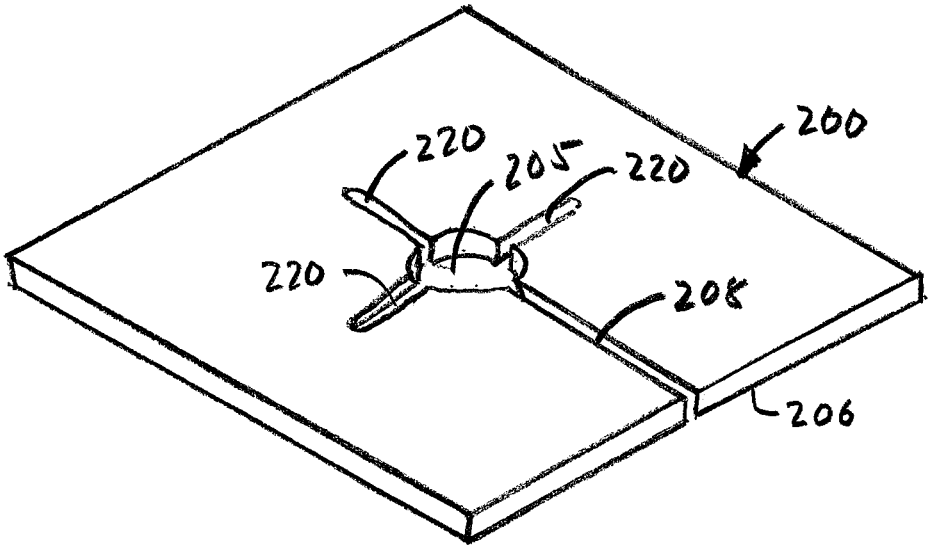
FIG. 8 is a perspective view of an alternate intumescent pad of the present invention.

FIG. 8 is a perspective view of an alternate intumescent pad 200 of the present invention. A smaller opening is used so that the pliable intumescent material sits closer to the continuity member 24, radial slits 220 that extend from the opening, or other differently shaped cut-outs can be provided in the pad to allow the pad to more easily flex if the continuity member comes into contact with the pad. The opening 205 is 0.5" in diameter and is designed to be used with a rod 24 that is between 0.5" and 1" in diameter. The slots 220 shown are 1/16" wide and ½" long.

Figure 9:
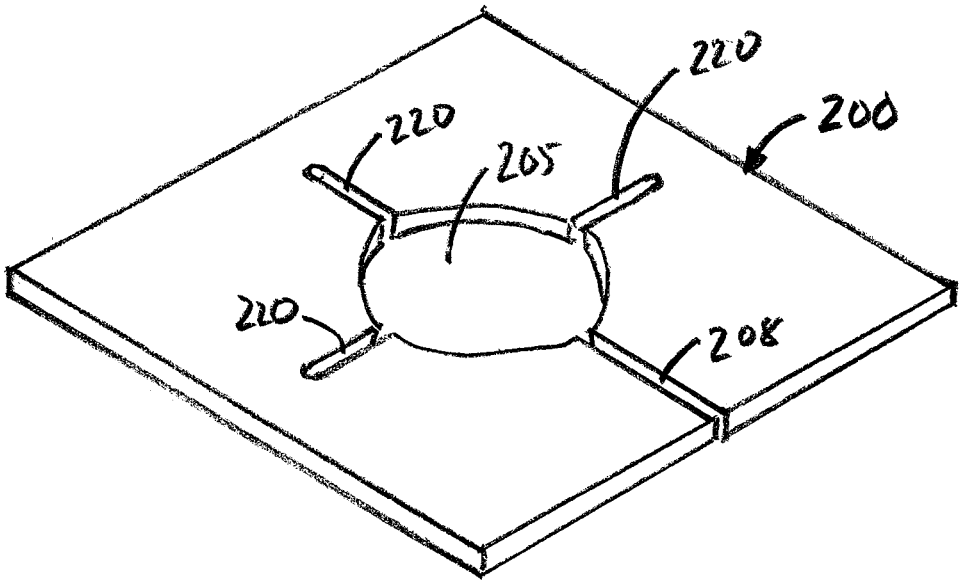
FIG. 9 is a perspective view of an alternate intumescent pad of the present invention attached to a covering plate.

FIG. 9 is a perspective view of an alternate intumescent pad 200 of the present invention attached to a covering plate. This pad 200 has a larger opening 205 than that shown in FIG. 8 and radial slits 220 similar to the pad 200 shown in FIG. 8. The opening 205 is 1.25" in diameter and is designed for use with a rod 24 that is between 1.25" and 2" in diameter.

Figure 10:
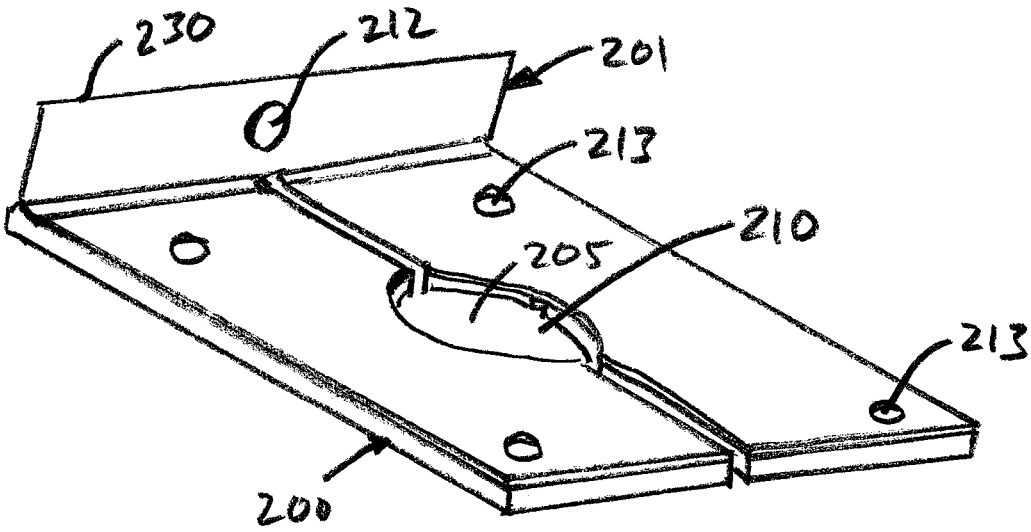
FIG. 10 is a perspective view of a covering plate formed according to the present invention with one or more intumescent pads attached to the plate.

FIG. 10 is a perspective view of a covering plate 201 formed according to the present invention with one or two intumescent pads 200 attached to the plate. Openings 213 can be formed in the intumescent pad and openings 214 can be formed in the covering plate to receive fasteners to attach the fire stop system to the horizontal plate. The plate 201 has an orthogonal flange 230 that allows for bending of the two side of the planar body of the plate 201 while keeping them engaged together during the bending process. If two separate plates were used to surround the continuity member 24, the installer may fail to use one of the plates, and the fire stopping system would not be as effective. The orthogonal flange can be bent at the opening 212 where the flange is weakened. The orthogonal flange 230 can be bent along a bend line through opening 212 that is orthogonal flange 230, thus swinging the sides of the body of the plate 201 within the plane of the body so that they separate.

Figure 11:
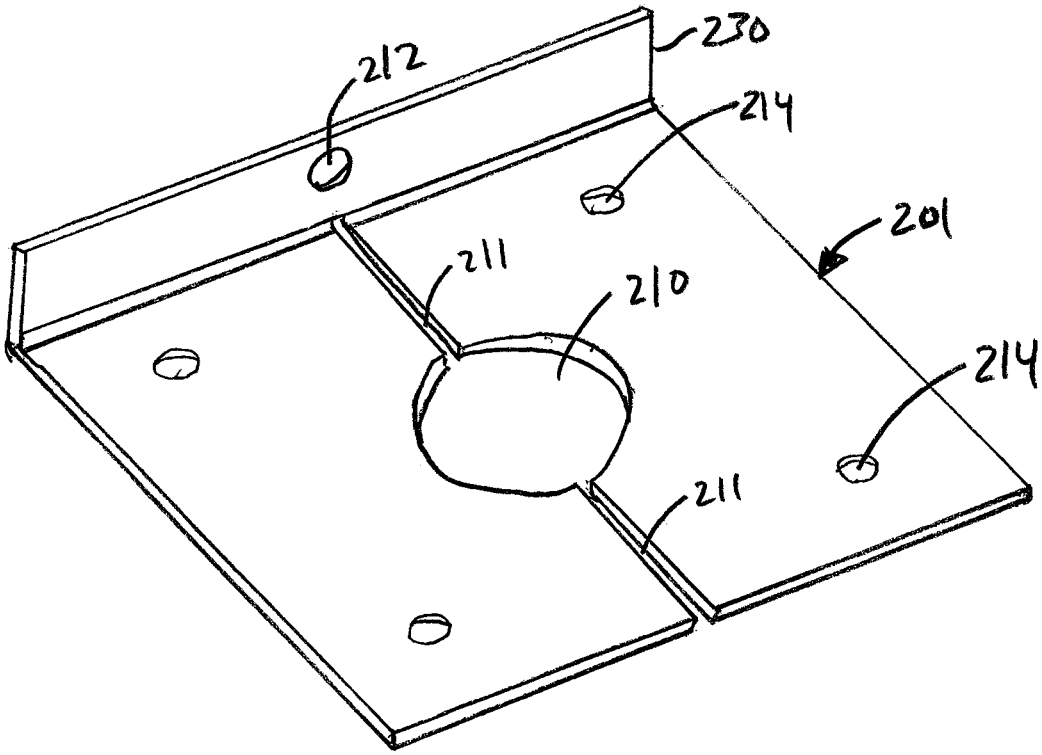
FIG. 11 is a perspective view of a covering plate formed according to the present invention.

FIG. 11 is a perspective view of a covering plate 201 formed according to the present invention. If a plate 201 is used with the pad 200, the plate 201 will have an opening 210 for receiving the vertical member 24 of the continuity system and the plate 201 can be formed with a slit 211 that communicates with the opening and both edges of the planar body of the plate 201 that will allow the plate 201 to open and fit over and around the continuity member 24. Additional weakening openings 212 can be formed in the plate 201 to help it to bend to fit over the continuity member 24.

Figure 12:
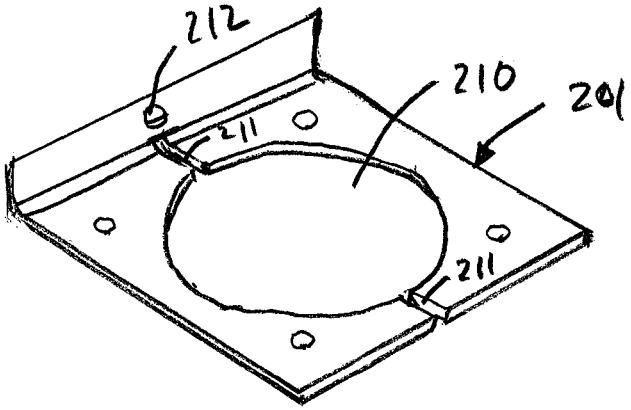
FIG. 12 is a perspective view of an alternate covering plate formed according to the present invention.

FIG. 12 is a perspective view of an alternate covering plate 201 formed according to the present invention. Dimensions provided are in inches. The 2.125" opening 210 in the plate can be used with continuity tie systems that use a 1.25" to 2" diameter rod or cable 24, and attaches to a nominal 2" by 4" lumber member.

Figure 13:
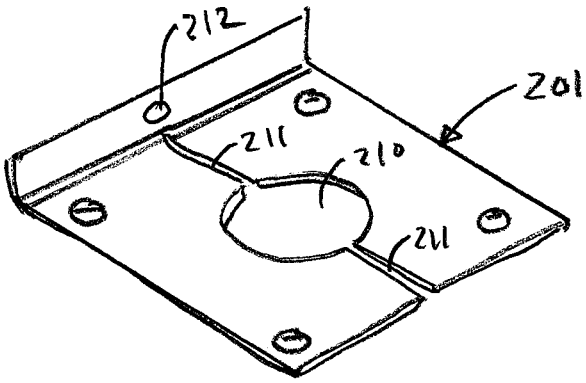
FIG. 13 is a perspective view of an alternate covering plate formed according to the present invention.

FIG. 13 is a perspective view of an alternate covering plate 201 formed according to the present invention. Dimensions provided are in inches. The 1.125" opening 210 in the plate can be used with continuity tie systems that use a 0.5" to 1" diameter rod or cable 24, and attaches to a nominal 2" by 4" lumber member.

Figure 14:
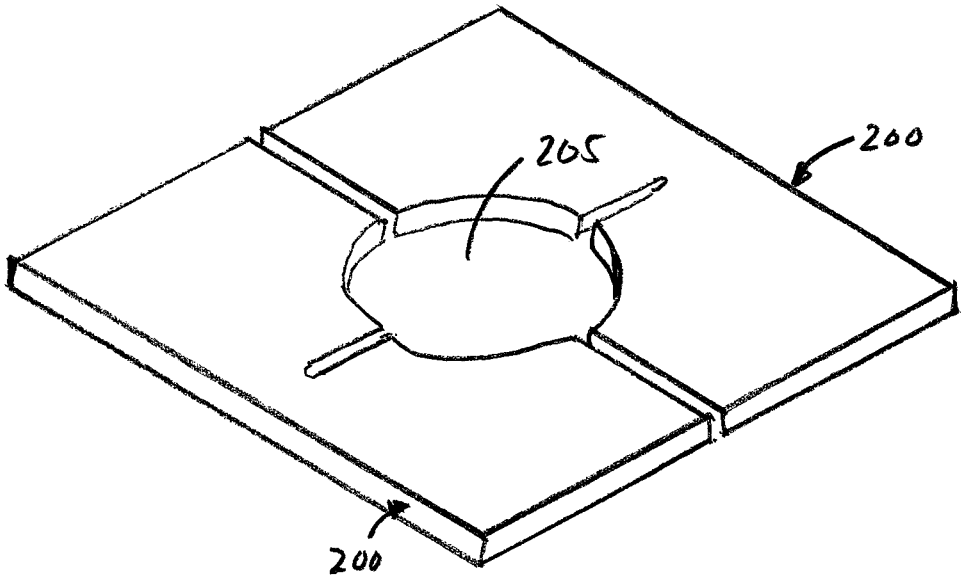
FIG. 14 is a perspective view of two intumescent pads of the present invention.

FIG. 14 is a perspective view of two intumescent pads 200 of the present invention. The pads could be used with a plate that is designed to be opened to attach around a continuity member 24. By having two separate pads the two sides of the body of the plate 201 separate more easily.

I claim:

1. A continuity tie system comprising:

a. a take-up device;

b. a first structural member to which the take-up device is fastened on a first side of the first structural member, the first structural member having an over-sized opening;

c. a tie rod with a top end at least partially held within an inner bore of the take-up device and inserted through the over-sized opening of the first structural member, the over-sized opening of the first structural member having an edge that defines the over-sized opening, the over-sized opening of the first structural member being relatively large compared to the tie rod to allow the tie rod to move through the first structural member unhindered with their being unobstructed space between the tie rod and the entire edge of the over-sized opening of the first structural member;

d. intumescent material applied to the first structural member around the over-sized opening of the first structural member with the intumescent material being a pliable and bendable intumescent pad; and e. a cover plate positioned on a second side of the first structural member, opposite the take up device on the first side and overlying portions of the intumescent material and attached to the first structural member, the cover plate having an over-sized opening through which the tie rod extends, the over-sized opening of the cover plate having an edge that defines the over-sized opening of the cover plate, the over-sized opening of the cover plate being relatively large compared to the tie rod to allow the tie rod to move through the cover plate unhindered with their being unobstructed space between the tie rod and the entire edge of the over-sized opening of the cover plate.

2. The connection of claim 1 wherein:

a. the first structural member is a top plate in an at least partially wood frame wall, and the take-up device rests on a bearing plate attached to the top plate.

3. The connection of claim 2 wherein:

a. the tie rod is secured to a foundation below the wood frame wall.

4. The connection of claim 1 wherein:

a. the take-up device has a central vertical axis;

b. the tie rod is not parallel to the central vertical axis of the take-up device.

5. A method of forming the connection of claim 1 comprising the steps of:

a. inserting the top end of the tie rod into the take-up device;

b. fastening the take-up device to the first structural member;

c. inserting the tie rod through a bottom portion of an outer bore in a housing of the take-up device; and d. inserting the tie rod through the first structural member.

6. The method of claim 5 wherein:

a. the take-up device is fastened to the first structural member with a plurality of screws.

7. The connection of claim 1 wherein:

a. the intumescent material is formed with one or more radial slits.

8. The connection of claim 1 wherein:

a. the intumescent material is formed with one or more radial slits that extend to an outer edge of the intumescent material.

9. The connection of claim 1 wherein:

a. the cover plate interfaces with the intumescent material with the intumescent material between the cover plate and the first structural member.

10. The connection of claim 9 wherein:

a. the cover plate has a flange formed at an edge of the cover plate.

11. The connection of claim 10 wherein:

a. the cover plate has an opening in the flange.

12. The connection of claim 1 wherein:

a. the intumescent material is applied to an underside of the first structural member.

13. A continuity tie system comprising:

a. a take-up device;

b. a first structural member to which the take-up device is fastened on a first side of the first structural member, the first structural member having an opening;

c. a tie rod with a top end at least partially held within the inner bore of the take-up device and inserted through the opening of the first structural member;

d. intumescent material applied to the first structural member around the opening, the intumescent material having one or more radial slits, and wherein the intumescent material does not enter the opening of the first structural member; and e. a cover plate positioned on a second side of the first structural member, opposite the take up device on the first side and overlying portions of the intumescent material and attached to the first structural member, the cover plate having an over-sized opening through which the tie rod extends, the over-sized opening of the cover plate having an edge that defines the over-sized opening of the cover plate, the over-sized opening of the cover plate being relatively large compared to the tie rod to allow the tie rod to move through the cover plate unhindered with their being unobstructed space between the tie rod and the entire edge of the over-sized opening of the cover plate.

14. The connection of claim 13 wherein:

a. the first structural member is a top plate in an at least partially wood frame wall, and the take-up device rests on a bearing plate attached to the top plate.

15. The connection of claim 14 wherein:

a. the tie rod is secured to a foundation below the wood frame wall.

16. The connection of claim 13 wherein:

a. the take-up device has a central vertical axis;

b. the tie rod is not parallel to the central vertical axis of the take-up device.

17. A method of forming the connection of claim 13 comprising the steps of:

a. inserting the top end of the tie rod into the take-up device;

b. fastening the take-up device to the first structural member; and c. inserting the tie rod through a bottom portion of an outer bore in a housing of the take-up device.

18. The connection of claim 1, wherein:

the intumescent pad is generally ⅛ inches thick.

19. The connection of claim 13, wherein:

the intumescent material is a pliable and bendable intumescent pad.

20. The connection of claim 13, wherein:

the intumescent material is in the form of a pad that is generally ⅛ inches thick.

* * * * *